United States Patent [19]

Katz

[11] Patent Number: 4,659,242

[45] Date of Patent: Apr. 21, 1987

[54] LEAD LOADING MECHANICAL PENCIL

[75] Inventor: Otto Katz, Schwabach, Fed. Rep. of Germany

[73] Assignee: A. W. Faber-Castell, Stein Bei Nuernberg, Fed. Rep. of Germany

[21] Appl. No.: 301,971

[22] Filed: Sep. 14, 1981

[30] Foreign Application Priority Data

Nov. 8, 1980 [DE] Fed. Rep. of Germany ..... 3042283

[51] Int. Cl.[4] ..... B43K 21/00; B43K 21/04; B43K 21/22

[52] U.S. Cl. ..... 401/85; 401/57; 401/65; 401/89; 401/90

[58] Field of Search ..... 401/65, 133, 67, 85, 401/89, 94, 192, 194, 57, 86, 87, 90; 221/64, 307; 215/247

[56] References Cited

U.S. PATENT DOCUMENTS

| | | | |
|---|---|---|---|
| 2,053,892 | 9/1936 | Beck | 401/133 |
| 2,370,250 | 2/1945 | Kupczyk | 401/67 |
| 2,563,551 | 8/1951 | Refsdal | 401/192 X |
| 3,306,493 | 2/1967 | Szajna | 221/64 |
| 4,247,215 | 1/1981 | Leuthold et al. | 401/85 |

*Primary Examiner*—Steven A. Bratlie
*Attorney, Agent, or Firm*—Michael J. Striker

[57] ABSTRACT

A mechanical pencil having an exchangeable lead storing container has a feeding mechanism provided at one end with a coupling pin which snugly fits a coupling recess formed in the storing cartridge. The feeding opening connecting the interior of the cartridge with the central passage in the coupling pin has normally a smaller diameter than that of leads stored in the cartridge, and only upon completing the coupling the pin enlarges the feeding opening to such an extent that the stored leads can freely pass one after the other into the feeding mechanism of the pencil.

5 Claims, 6 Drawing Figures

FIG. 1
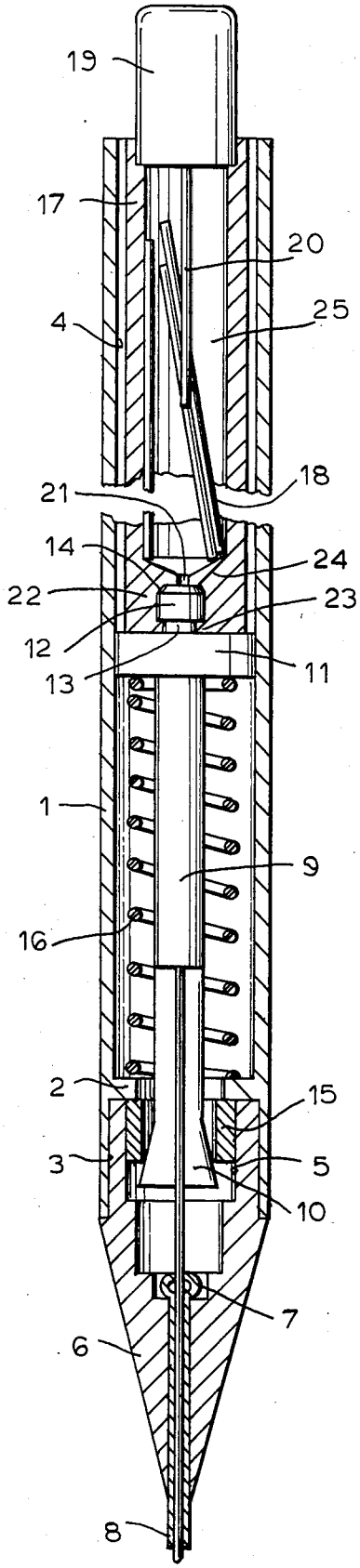
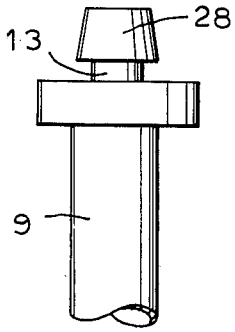
FIG. 2a

LEAD LOADING MECHANICAL PENCIL

BACKGROUND OF THE INVENTION

This invention relates in general to mechanical pencils, and in particular to a pencil having an exchangeable lead storing container which is releasably coupled to a lead feeding mechanism. The feeding mechanism includes a tubular member with a lead-clamping collet at one end and with a coupling pin at the other end engageable with the storage container, the tubular member being spring-biased into a clamping position and displaceable from the clamping position by an actuation part.

In most cases, conventional mechanical pencils have a lead feeding mechanism which uses a collet for clamping the lead, the collet being operated by means of a pressure knob at the rear end of the pencil or by a similar actuation member. When the pencil is held in an approximately perpendicular position and the feeding mechanism is activated, a lead from the storage container is advanced after a lead being used in the feeding mechanism. Accordingly, the lead storage containers have to be designed in such a manner as to accommodate a plurality of leads and discharge the same one after the other, so that a new lead can be fed through the tip of the pencil when the old lead is consumed. In order to ensure proper functioning of the mechanical pencil, the leads must be easily replaceable, and in addition it is necessary to ensure that the spare leads be transported without trouble from the container to the tip of the pencil.

In the German published patent application No. 28 31 750, a mechanical pencil is described in which spare leads are contained in a capsule in the form of a cylindrical hollow body which at one end thereof is provided with a bottom and at the other end has a removable cap. The leads to be stored in this capsule are shorter than the length of the inner space of the capsule, so that a part of the latter could be used as guiding means for facilitating the insertion of the cylindrical body of the capsule on the lead feeding mechanism. In order to ensure that only those capsules storing leads of a diameter matching the diameter of the lead feeding mechanism be used, the cylindrical member of the feeding mechanism as well as the cylindrical body of the capsule are provided respectively with the same number of guides distributed at uniform spacing so as to permit the insertion of a matching storage capsule only.

Known also are containers for spare leads in the form of cartridges of plastic material having a cylindrical attachment piece connectable to a lead storing container which is firmly built in the mechanical pencil. These containers have the disadvantage that upon the removal of the closure cap the leads are prone to fall out from the cartridge before the latter is plugged into the pencil. Moreover, over, excessive number of leads can be loaded into the pencil from such a cartridge, thus causing wedging of the leads one against the other, and consequently the feeding of the leads into the feeding mechanism is unreliable. This disadvantage has been removed in a lead storing cartridge according to German Gebrauchsmuster No. 77 23 734. This known cartridge has two chambers wherein only a limited number of leads can be stored. It is a disadvantage of this device that, after the removal of the closing gap, there is still the possibility that the leads unintentionally drop out before the cartridge is coupled to the pencil for loading the thin leads. This shortcoming is not removed in any of the prior-art lead storing cartridges.

Also known are ink storing cartridges for fountain pends which are completely sealed and permit the discharge of the writing medium only when a plug-in connection between the cartridge and a container in the fountain pen is established, thus making the operation more comfortable for the user.

SUMMARY OF THE INVENTION

A general object of the present invention is to overcome the aforementioned disadvantages of prior-art mechanical pencils.

More particularly, it is an object of the invention to provide an improved mechanical pencil of the abovedescribed type which is simpler in maintenance than prior-art pencils of this kind, particularly in exchanging the cartridges with leads, without changing the construction of existing feeding mechanisms of the pencils.

An additional object of the invention is to provide such an improved pencil which does not necessitate the separation into two parts when exchanging the lead storing cartridge.

A further object of the invention is to provide such an improved pencil which indicates to the user when a new lead storing cartridge is to be exchanged.

Still another object of this invention is to provide a mechanical pencil which is simple in construction and requires minimum manufacturing costs for the improved exchange of cartridges.

In keeping with these objects, and others which will become apparent hereafter, one feature of the invention resides, in a mechanical pencil of the above-described type, in the provision of a lead storing cartridge which is provided at one end thereof with a coupling recess communicating with the interior of the cartridge through a locking opening, the diameter of which is smaller than the diameter of leads stored in the cartridge, and the end of the feeding member formed with a coupling pin has a configuration which, upon insertion into the recess of the cartridge, enlarges the diameter of the locking opening, so that the leads are permitted to pass therethrough. Furthermore, in order to signal acoustically or by touch to the user that the cartridge is properly connected to the pencil, the coupling pin is provided with a snap groove, and the recess is formed with a snap bulge engageable with the groove. Another indication is provided for the user to see the amount of leads available in the storing cartridge, by making the latter of a transparent material and arranging the leads to be in contact with the bottom partition of the capsule, whereas the opposite ends of the leads support an indication disk which is guided on a cleaning needle projecting inwardly from the closure cap of the cartridge.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a sectional side view of a lead loading mechanical pencil with a pressure-operated feeding mechanism in connection with a lead storing cartridge;

FIG. 2*a* is a cut-away end portion of the feeding tubular member with a coupling pin of a frustoconical configuration;

DESCRIPTION OF THE PREFERRED EMBODIMENTS

Figure 2:
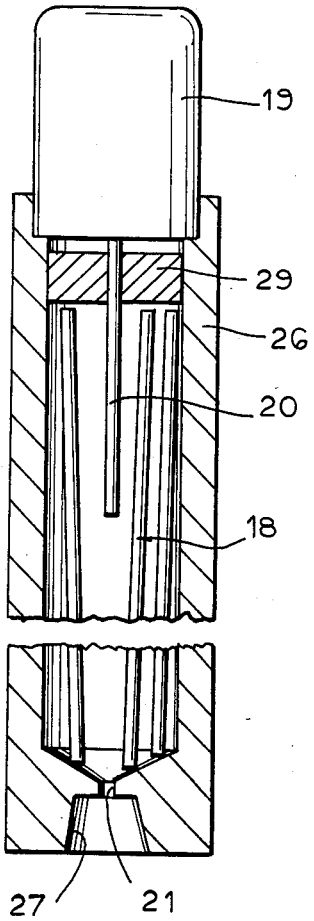
FIG. 2 is a modification of the cartridge of FIG. 1 provided with an indicator disk.

Referring firstly to FIG. 1, there is illustrated a lead loading mechanical pencil having a pressure-activated feeding mechanism. The pencil is of conventional design consisting of a tubular housing 1 formed at its lower part with inner stop flange 2 and with an inner thread 3 engaging outer thread of a tapering tip 6 of the pencil. The base of the tip 6 is formed with a guiding bore or well 5 having an inner diameter which exceeds the clearance of the stop flange 2. At the bottom of well 5 a lead brake 7 is arranged in contact with a lead guiding tube 8 extending throughout the tapered tip 6. The feeding mechanism includes a tubular member 9 formed at its lower end with a collet 10 for clamping the lead and at its opposite end with a guiding collar 11 adjoining an upwardly directed coupling pin 12. The coupling pin is formed with a snap groove 13 and its end portion is in the form of a chamber or bevel 14. Collet 10 has sloping outer walls cooperating with a clamping ring 15 which is movable between the bottom of the well 5 and the lower surface of the stop flange 2. The upper surface of flange 2 supports a pressure spring 16 which at its other end abuts against the driving collar 11 to bias the feeding mechanism with collet 10 and clamping ring 15 upwardly until the latter engages with the stop flange 2 and causes the collet to clamp the lead which has been loaded in the feeding member 9.

The exchangeable lead storing container 17, which is designed for accommodating a plurality of leads 18, is closed at its upper end by a plug 19 which may also serve as an actuation member for compressing the feeding mechanism against the biasing spring 16. The plug 19 can be in the form of an eraser and can be associated with a cleaning needle 20 projecting into the interior 4 of the housing 1. The bottom of container 17 is formed with a locking opening 21 situated opposite the central passaage of the feeding tube 9. This locking opening 21 is extendible and, normally, when container 17 is disengaged from the coupling pin 12 its diameter is smaller than the diameter of leads 18 in the storage space 25 of the container. As soon as a recess in the annular bottom wall portion 22 of container 17 is brought into engagement with the coupling pin 12, the latter resiliently extends the inner diameter of the annular bottom portion and thus the diameter of the locking opening 21 to such an extent as to exceed the diameter of the leads 18. The coupling pin 12 is formed with a snap groove 13 which upon completion of the coupling with the container 17 engages a corresponding snap bulge 23 at the rim of the recess in the wall portion 22 so that the user can sense both acoustically and by touch that the proper coupling of the container to the feeding mechanism has been established. The bottom partition 24 between the guiding annular wall portion 22 and the locking opening 21 has with advantage a funnel-like configuration sloping from the storage space 25 toward the locking opening.

Another embodiment of the lead storing cartridge according to this invention is illustrated in FIG. 2. The cartridge 26, similarly to the container 17 in FIG. 1, has an annular bottom wall formed with a recessed cone 27 which is engageable with an outer cone 28 (FIG. 2*a*) at the end of the tubular feeding member 9. Respective sizes of the inner and outer cones 27 and 28 are selected such that the locking opening 21 is again extended when the coupling is completed. Cartridge 26, similarly to the preceding example, is again closed by a plug 19 formed with an inwardly projecting cleaning needle 20. In this example, the cleaning needle 20 guides an indicator disk 29 and the jacket of cartridge 26 is made of a transparent or translucent material, whereas the disk is colored. When coupled with the lead feeding mechanism, the upper end portion of cartridge 26 overlaps the rim of housing 1 so that the indicator disk 29 is visible when at least one lead is present in the storage space.

Figure 3:
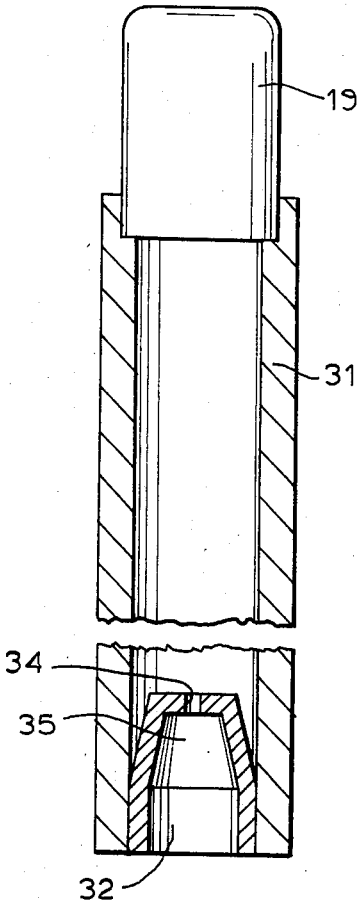
FIG. 3 is another modification of the lead storing cartridge.

FIG. 3 illustrates another embodiment of lead storing cartridge 31 which again is closed at its upper end by an actuation knob or plug 19, whereas the other end is closed by a cup-shaped insert 32 defining a frustoconical coupling recess 35. The insert 32 has a base forming the bottom of the storage space of the tubular cartridge 31 and being formed with the locking opening 34 which connects the storage space with the coupling recess 35. The use of a separate insert 32 permits an optimum selection of materials for the whole cartridge, both for the jacket 31 and the insert 32 itself. At least the base or bottom partition 33 on the insert must be resiliently deformable in order to enlarge the locking opening 34 when the cartridge is plugged onto the slightly larger coupling cone at the end of the feeding tube 9.

Figure 4:
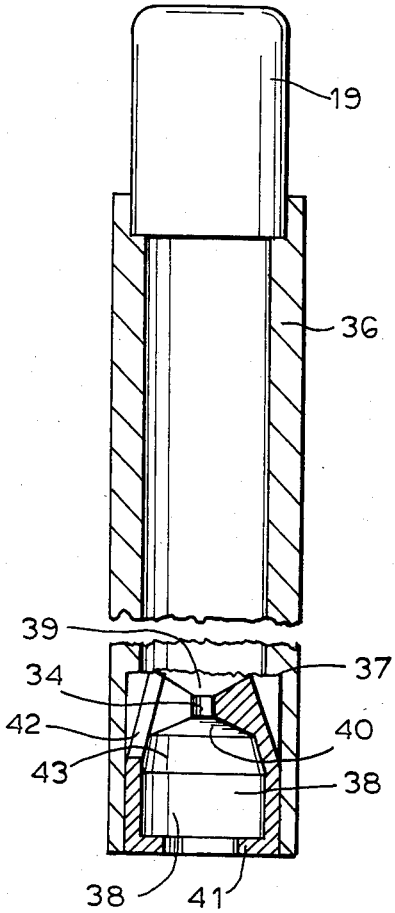
FIG. 4 is still another modification of the lead storing cartridge, having a bottom insert.

Another embodiment is illustrated in FIG. 4 where the tubular jacket 36 of the cartridge is again closed at its upper end with the plug 19 and at its lower end is formed with an inner shoulder 37 against which the coupling insert 38 is pressed in from the lower open end. The base of the cup-shaped insert 38 defines at its upper surface a recessed cone acting as a feeding funnel 39, whereas at the opposite surface there is formed a centering funnel communicating with locking opening 34. The second centering funnel 40 serves for guiding a lead projecting from the feeding mechanism 9 into the locking opening when a new cartridge is being applied on the coupling cone, thus preventing an accidental breakage of this lead. The recessed coupling cone 43 in the insert, as well as the base part containing the opening 34, is formed with slots 42 which facilitate the enlargement of the diameter of the opening 34.

Figure 5:
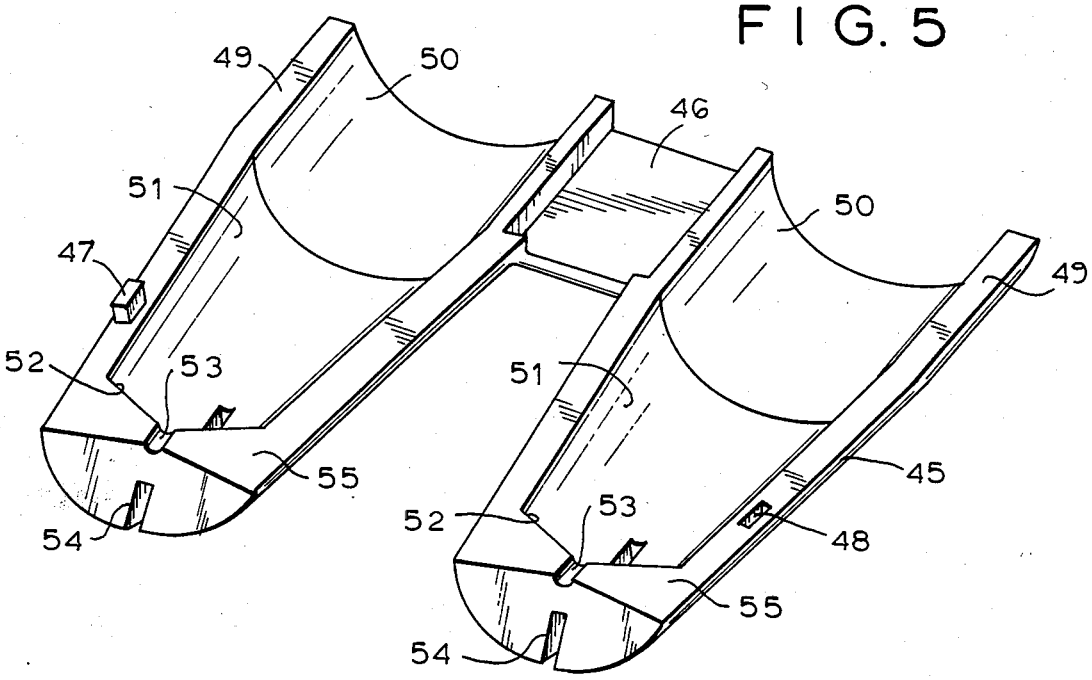
FIG. 5 is a perspective view of a bottom insert of FIG. 4 in its unfolded condition.

Since this embodiment of a lead feeding cartridge is particularly suitable for use with leads having a minute diameter, it is of advantage when the insert defining the bottom partition and the coupling cone is assembled of two half shells 45 interconnected by a flexible web-like hinge 46, as illustrated in FIG. 5.

An accurate centering of the two half shells 45 and the fit relative to each other is effected by an arresting pin 47 which engages at least one snapping recess 48 in the opposite half shell, whereby the two half shells contact each other at abutment surfaces 49. As has been mentioned before, this embodiment of the separation insert defines also a cylindrical guiding recess 50 which continues with a tapering coupling portion 51. The coupling recess portion 51 is terminated again with a guiding funnel 52 communicating with the locking opening 53 formed in the separating bottom partition 55. Slots 54 serve for facilitating the enlargement of the locking opening 53 when the coupling pin is inserted into the recessed portion 51.

Each of the embodiments of lead storing cartridges illustrated in FIGS. 1–5 is suitable for insertion into a conventional mechanical pencil illustrated by way of example in FIG. 1. The storage container 17 is introduced into the housing 1 through its open upper end, and by applying a slight pressure against the plug 19 it is brought into coupling engagement with the pin 12; proper engagement is indicated acoustically and is also detectable by touch when the snap bulge 23 is arrested in the snap groove 13. Simultaneously, the locking opening 21 is extended in diameter to such an extent that one of the leads 18 enters the central feeding channel of the tubular member 9. By pressing the plug 19, the tubular member 9 together with its collet 10 and the clamping ring 15 is displaced downwardly, the pliers of collet 10 are relieved, and the lead is fed in a conventional manner through the lead brake 7 and the guiding tube 8 until its leading part projects out of the tip 6 of the pencil. Since the locking opening 21 is permanently enlarged after the consumption of the first lead 18, another lead from the storage space 25 is fed through the tubular member 9.

In the embodiment according to FIG. 2, instead of a cylindrical coupling pin, a frustoconical coupling pin 28 is used to ensure an easier extension of the locking opening 21. The bevelled edge of the cylindrical pin 12 in the preceding example serves the same purpose.

Particularly for mass production of cartridges 17, 26, 31 and 36, it is of advantage when the walls of the cartridges are made of a plastic material. For an optimum selection of materials suitable for respective parts of the cartridge, it is of advantage when the cartridge is made of two pieces, apart from the closure plug 19. Particularly the separation inserts 32 or 38 are made of a plastic material having a larger elasticity than the plastic material used for the production of cylindrical jackets of the cartridges. In the embodiment according to FIG. 4, the recessed shoulder 37 in the inner wall of the jacket 36 overlaps the interspace resulting from the inclination of the tapering part of the insert 38 so that no lead could accidentally be wedged in this interspace before the coupling pin enlarges radially outwardly the conical coupling part 43 and eliminates this clearance.

In loading additional leads into the mechanical pencil, in the device according to this invention the used up cartridge must be removed from the housing of the pencil and a new fully loaded cartridge with a new eraser plug is inserted in the above-described manner into the housing 1. The user need not have any particular skill in exchanging the cartridges, and also no part of the pencil is to be disconnected. Accordingly, the maintenance of the mechanical pencil with the cartridge according to this invention is still simpler than that of the fountain pens provided with the known ink cartridges which, as known, can be inserted into the fountain pen only after unscrewing the shank of the holder of the fountain pen. When a transparent cartridge equipped with the indicator disk 29 resting on the stored leads is used, then upon the consumption of the last lead the disk drops and it is possible to see on the first side that the cartridge must be replaced. As mentioned before, for this purpose it is necessary only to make the cartridge slightly longer so that the end portion of the cartridge with the indicator disk be visible from the pencil housing 1.

By modifying the diameter and the length of the coupling pin in the lead feeding mechanism, it is possible to adjust the lead storing cartridges so that any mistakes in the loading operation are eliminated. For example, a cartridge including leads of a larger diameter can thus be prevented from being inserted in a pencil the coupling pin of which is dimensioned for another inner diameter of the coupling part of the cartridge.

It will be understood that each of the elements described above, or two or more together, may also find a useful application in other types of constructions differing from the types described above.

While the invention has been illustrated and described as embodied in a mechanical pencil having a collettype feeding mechanism, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lead loading mechanical pencil having an exchangeable container for storing a plurality of leads, comprising a housing and within the housing a lead feeding mechanism including a spring-biased tubular member with a lead clamping means at one end and with a coupling pin at the other end; actuation means for controlling the clamping means; said container including a resiliently deformable bottom wall of annular configuration defining on its outer surface a coupling recess for engaging the coupling pin, said coupling recess having an annular bottom portion formed with a locking opening communicating with the interior of the container, the inner diameter of the locking opening in a disengaged condition of the recess relative to the pin being smaller than the diameter of the leads, and the outer diameter of the pin slightly exceeding the inner diameter of the bottom portion of the recess so that upon coupling the recess with the pin the locking opening is resiliently extended to exceed the diameter of the leads, said container having a cylindrical jacket fitting the interior of said housing, one end portion of said jacket being formed with said bottom wall, said container being assembled of a tubular jacket, of an actuation plug closing the upper end of said jacket and of a separation insert in the lower end of the jacket constituting the bottom wall with the locking opening and the coupling recess, the coupling recess in said insert defining a guiding portion and a conical coupling portion and at least one slot in the bottom wall directed to the locking opening to facilitate its extension when the conical portion is extended by the coupling pin, the guiding portion of said recess having a cylindrical configuration and the base of said conical coupling portion having a funnel-like shape sloping toward said locking opening, the insert having a base wall communicating with the interior of said container, said base wall being of a funnel-like configuration sloping toward said locking opening, and wherein the inner wall of said tubular jacket defines a recessed flange arranged substantially at the level of said bottom wall.

2. A lead loading mechanical pencil having an exchangeable container for storing a plurality of leads, comprising a housing and within the housing a lead feeding mechanism including a spring-biased tubular member with a lead clamping means at one end with a coupling pin at the other end; actuation means for controlling the clamping means; said container including a resiliently deformable bottom wall of annular configuration defining on its outer surface a coupling recess for engaging the coupling pin, said coupling recess having an annular bottom portion formed with a locking opening communicating with the interior of the container, the inner diameter of the locking opening in a disengaged condition of the recess relative to the pin being smaller than the diameter of the leads, and the outer diameter of the pin slightly exceeding the inner diameter of the bottom portion of the recess so that upon coupling the recess with the pin the locking opening is resiliently extended to exceed the diameter of the leads, said container having a cylindrical tubular jacket fitting the interior of said housing, one end portion of said jacket being formed with said bottom wall, an actuation plug closing the upper end of said jacket, a separation insert in the lower end of the jacket constituting the bottom wall with the locking opening and the coupling recess, and wherein said separation insert is assembled of two half shells forming together the coupling recess and the bottom wall with the locking opening.

3. A pencil as defined in claim 2, wherein said coupling recess includes an introductory guiding portion and a frustoconical coupling portion terminated with said bottom wall and further including a slot formed in said bottom wall and in said coupling portion to facilitate extension of said locking opening.

4. A pencil as defined in claim 2, wherein said half shells are formed with mating surfaces, one being provided with an arresting pin and the other with a corresponding arresting recess.

5. A pencil as defined in claim 4, wherein said half shells are interconnected by a resilient hinge member.

* * * * *